US008068075B2

(12) United States Patent
Nakao

(10) Patent No.: US 8,068,075 B2
(45) **Date of Patent: *Nov. 29, 2011**

(54) LIQUID CRYSTAL DISPLAY DEVICE

(75) Inventor: Kenji Nakao, Kanazawa (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 1047 days.

This patent is subject to a terminal disclaimer.

(21) Appl. No.: 11/505,890

(22) Filed: Aug. 18, 2006

(65) Prior Publication Data

US 2006/0274017 A1 Dec. 7, 2006

Related U.S. Application Data

(63) Continuation of application No. PCT/JP2005/002650, filed on Feb. 18, 2005.

(30) Foreign Application Priority Data

Feb. 20, 2004 (JP) ..... 2004-045209

(51) Int. Cl.
*G09G 3/36* (2006.01)

(52) U.S. Cl. ..... 345/87; 345/94

(58) Field of Classification Search ..... 345/87–89, 345/94, 95, 99, 204, 690, 691; 349/33, 75, 349/76, 120, 123

See application file for complete search history.

(56) References Cited

U.S. PATENT DOCUMENTS

| | | | | |
|---|---|---|---|---|
| 7,126,573 | B2 * | 10/2006 | Park et al. | 345/94 |
| 2002/0057247 | A1 | 5/2002 | Lee et al. | |
| 2002/0093480 | A1 * | 7/2002 | Mizutani et al. | 345/102 |
| 2002/0126108 | A1 * | 9/2002 | Koyama et al. | 345/204 |
| 2002/0149549 | A1 * | 10/2002 | Ohta et al. | 345/87 |
| 2003/0001809 | A1 * | 1/2003 | Hattori et al. | 345/87 |
| 2003/0122753 | A1 | 7/2003 | Park | |
| 2003/0142118 | A1 * | 7/2003 | Funamoto et al. | 345/691 |
| 2004/0075635 | A1 * | 4/2004 | Arimoto et al. | 345/101 |
| 2005/0062705 | A1 * | 3/2005 | Yamada | 345/94 |

FOREIGN PATENT DOCUMENTS

| | | | |
|---|---|---|---|
| JP | 2002-303849 | A | 10/2002 |
| JP | 2003-121881 | | 4/2003 |
| JP | 2003-202546 | A | 7/2003 |
| JP | 2004-361616 | A | 12/2004 |
| KR | 2001-0081976 | | 8/2001 |
| TW | 526378 | | 4/2003 |
| TW | 527508 | | 4/2003 |

OTHER PUBLICATIONS

Burr-Brown Products from Texas Instruments, Multi-Clock Generator PLL1700, Jan. 1998, p. 6.*
U.S. Appl. No. 11/505,885, filed Aug. 18, 2006, Nakao, et al.
U.S. Appl. No. 11/505,898, filed Aug. 18, 2006, Igarashi, et al.
U.S. Appl. No. 12/236,868, filed Sep. 24, 2008, Nakao, et al.

* cited by examiner

*Primary Examiner* — Nitin Patel
(74) *Attorney, Agent, or Firm* — Oblon, Spivak, McClelland, Maier & Neustadt, L.L.P.

(57) ABSTRACT

The liquid crystal display device of the invention includes a liquid crystal display element section that is initialized such that the alignment state of liquid crystal molecules is transitioned from a splay alignment to a bend alignment capable of displaying an image, and a driving circuit that applies to the liquid crystal display element section a transition voltage that causes the alignment state of liquid crystal molecules to be transitioned from the splay alignment to the bend alignment in the initialization. Further, a clock signal generator generates upon supply of power to the driving circuit, a clock signal, which is delivered to the driving circuit, as a reference for starting application of the transition voltage and for measuring a transition voltage application period.

8 Claims, 5 Drawing Sheets

LIQUID CRYSTAL DISPLAY DEVICE

CROSS-REFERENCE TO RELATED APPLICATIONS

This is a Continuation Application of PCT Application No. PCT/JP2005/002650, filed Feb. 18, 2005, which was published under PCT Article 21(2) in Japanese.

This application is based upon and claims the benefit of priority from prior Japanese Patent Application No. 2004-045209, filed Feb. 20, 2004, the entire contents of which are incorporated herein by reference.

BACKGROUND OF THE INVENTION

1. Field of the Invention

The present invention relates to a liquid crystal display device that uses OCB (Optically Compensated Bend) liquid crystal display elements in order to display an image.

2. Description of the Related Art

The liquid crystal display device includes a liquid crystal display panel that constitutes a matrix array of OCB liquid crystal display elements. The liquid crystal display panel includes an array substrate in which a plurality of pixel electrodes are covered with an alignment film and arrayed in a matrix, a counter-substrate in which a counter-electrode is covered with an alignment film and disposed so as to face the pixel electrodes, and a liquid crystal layer that is held between the array substrate and the counter-substrate in contact with each of the alignment films. Further, the liquid crystal display panel is configured such that a pair of polarizers are attached to the array substrate and the counter-substrate via optical retardation plates (see Jpn. Pat. Appln. KOKAI Publication No. 9-185032, for instance). Each of the OCB liquid crystal display elements serves as a pixel in a range of the associated pixel electrode. In the OCB liquid crystal display element, the alignment state of liquid crystal molecules needs to be transitioned from a splay alignment to a bend alignment, which is capable of displaying an image, with the application of a transition voltage that is different from a normal driving voltage.

For example, in TV sets and mobile phones, a liquid crystal display device is connected to an image information processing unit provided as an external signal source. A display and a sync signal are input from the image information processing unit to the liquid crystal display device, thereby enabling the liquid crystal display device to effect display. The image information processing unit includes a microcomputer that performs an image information process, and a power supply unit that outputs a power supply voltage to the microcomputer and the liquid crystal display device. As is illustrated in FIG. 7, a power switch is turned on at T1, and after the power supply unit is stabilized, the output of the power supply voltage begins at T2. The microcomputer starts the image information process at T3 after the elapse of a predetermined time from T2. A sync signal and a display signal, which are obtained at T4 as a result of the image information process, are delivered to the liquid crystal display device.

The liquid crystal display device is provided with a driving circuit for driving the OCB liquid crystal display elements. In the prior art, the driving circuit uses the sync signal from the image information processing unit also as a clock signal that is necessary for applying a transition voltage. Specifically, the application of the transition voltage is started at T4 at which the clock signal is supplied from the image information processing unit, and a time period during which the transition voltage is applied is measured with reference to the clock signal. If the transition to the bend alignment is completed at T5, the driving circuit drives the OCB liquid crystal display elements with use of the sync signal and display signal, thus causing the OCB liquid crystal display elements to display an image corresponding to the display signal. In this structure, a setup time (T1-T5) of two or three seconds is needed. Users of TV sets and mobile phones feel this setup time very long.

BRIEF SUMMARY OF THE INVENTION

An object of the present invention is to solve the above-described problem by providing a liquid crystal display device capable of decreasing a setup time that is needed until an image is displayed.

According to the present invention, there is provided a liquid crystal display device comprising: a liquid crystal display element section that is initialized such that the alignment state of liquid crystal molecules is transitioned from a splay alignment to a bend alignment capable of displaying an image; a driving circuit that applies to the liquid crystal display element section a transition voltage that causes the alignment state of liquid crystal molecules to be transitioned from the splay alignment to the bend alignment as the initialization; and a clock signal generator that generates upon supply of power to the driving circuit, a clock signal, which is delivered to the driving circuit, as a reference for starting application of the transition voltage and for measuring a transition voltage application period in which the transition voltage is applied.

In this liquid crystal display device, the supply of the clock signal by the clock signal generator begins immediately after supply of power to the driving circuit. Thus, the application of transition voltage begins earlier than in the prior art. Therefore, the setup time that is needed until an image is displayed can be decreased.

DETAILED DESCRIPTION OF THE INVENTION

A liquid crystal display device according to an embodiment of the present invention will now be described with reference to the accompanying drawings.

Figure 1:
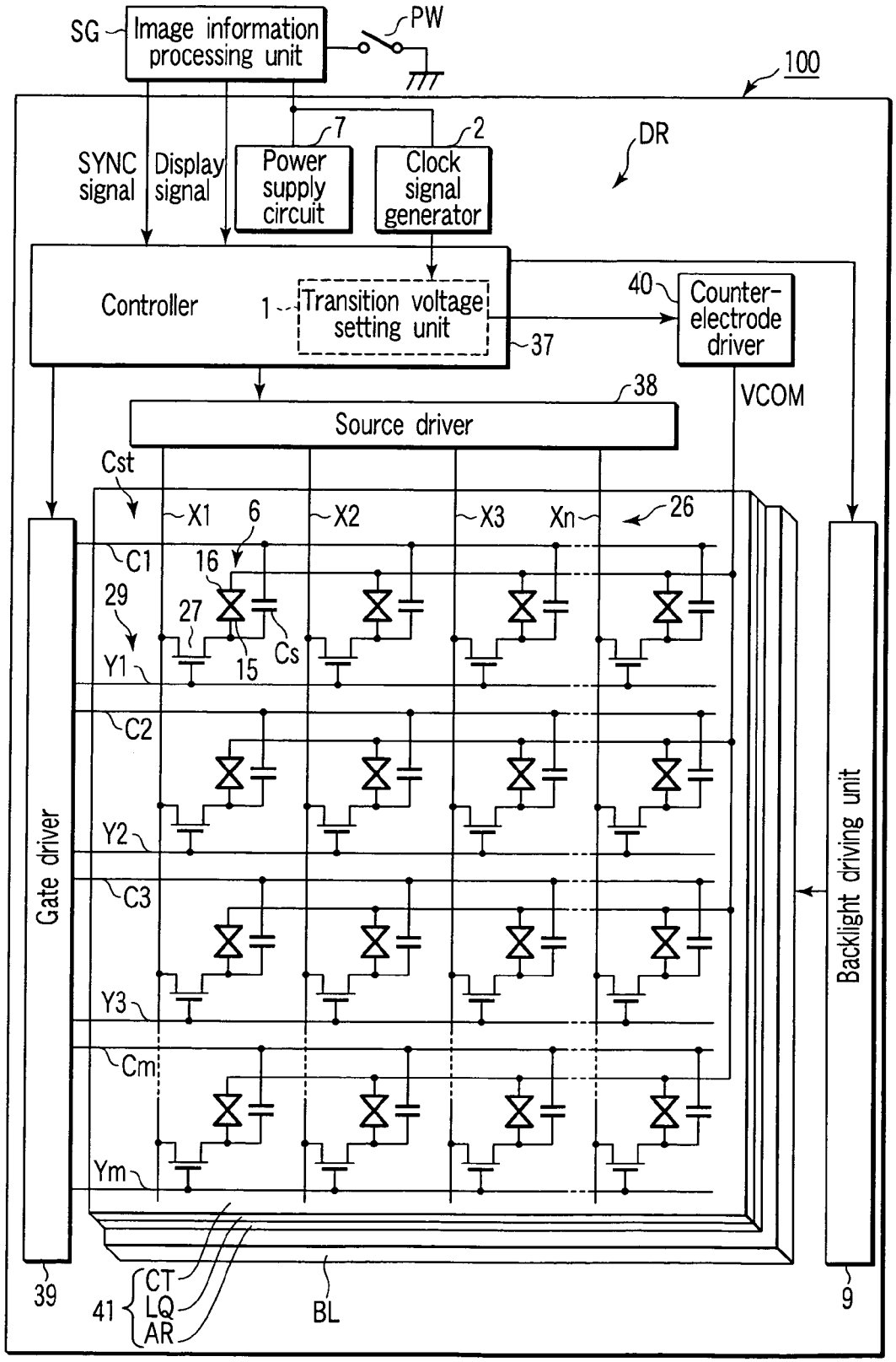
FIG. 1 is a diagram schematically showing the circuit configuration of a liquid crystal display device according to an embodiment of the present invention.
Figure 2:
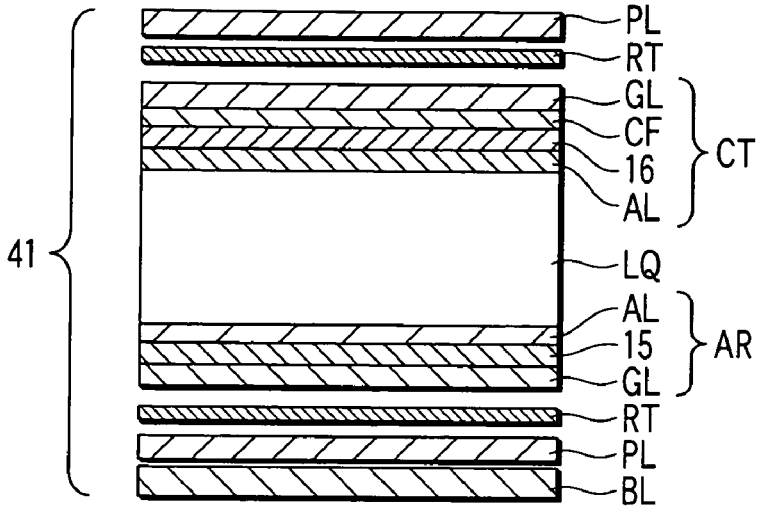
FIG. 2 is a diagram showing a partial cross-sectional structure of a liquid crystal display panel shown in FIG. 1.
Figure 3:
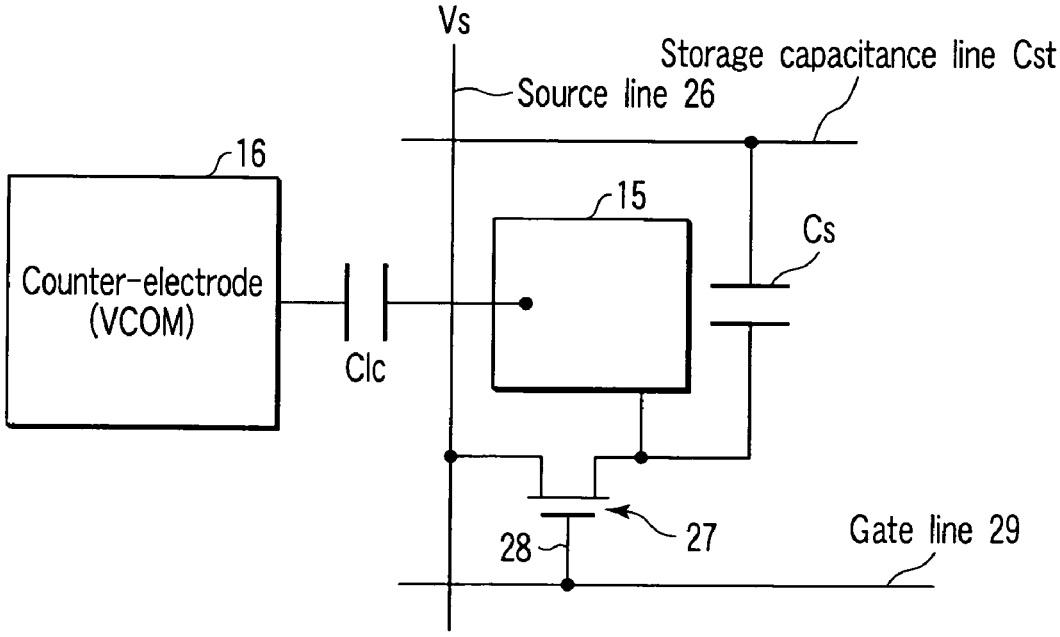
FIG. 3 is a diagram showing the circuit configuration of an OCB liquid crystal display element that performs display for one pixel with the cross-sectional structure shown in FIG. 2.

FIG. 1 schematically shows the circuit configuration of the liquid crystal display device 100, FIG. 2 shows a partial cross-sectional structure of a liquid crystal display (LCD)

panel 41 shown in FIG. 1, and FIG. 3 shows the circuit configuration of an OCB liquid crystal display element 6 that performs display for one pixel with the cross-sectional structure shown in FIG. 2.

The liquid crystal display device 100 is connected to an image information process unit SG provided as an external signal source, for example, in a TV set or a mobile phone. The image information processing unit SG includes a microcomputer that performs an image information process, and a power supply unit that outputs a power supply voltage to the microcomputer and the liquid crystal display device 100. The output of the power supply voltage is started after a power switch PW, which is provided on the image information processing unit SG side, is turned on and the power supply unit is stabilized. The microcomputer starts the image information process after the elapse of a predetermined time therefrom. A sync signal and a display signal, which are obtained as a result of the image information process, are delivered to the liquid crystal display device 100.

The liquid crystal display device 100 includes an LCD panel 41 that constitutes a matrix array (liquid crystal display element section) of OCB liquid crystal display elements 6; a backlight BL that illuminates the LCD panel 41; and a driving circuit DR that drives the LCD panel 41 and backlight BL. The LCD panel 41 includes an array substrate AR, a counter-substrate CT, and a liquid crystal layer LQ. The array substrate AR includes a transparent insulating substrate GL that is formed of, e.g. a glass plate; a plurality of pixel electrodes 15 that are formed on the transparent insulating substrate GL; and an alignment film AL that covers the pixel electrodes 15. The counter-substrate CT includes a transparent insulating substrate GL that is formed of, e.g. a glass plate; a color filter layer CF that is formed on the transparent insulating substrate GL; a counter-electrode 16 that is formed on the color filter layer CF; and an alignment film AL that covers the counter-electrode 16. The liquid crystal layer LQ is obtained by filling a liquid crystal in a gap between the counter-substrate CT and array substrate AR. The color filter layer CF includes a red color layer for a red pixel, a green color layer for green pixels, a blue color layer for blue pixels, and a black color (light-shielding) layer for a black matrix. In addition, the LCD panel 41 includes a pair of retardation plates RT that are disposed on the outside of the array substrate AR and counter-substrate CT, and a pair of polarizers PL that are disposed on the outside of the retardation plates RT. The backlight BL is disposed, as a light source, on the outside of the polarizer PL that is disposed on the array substrate AR side. The alignment film AL on the array substrate AR side and the alignment film AL on the counter-substrate CT side are subjected to rubbing treatment in parallel directions.

In the array substrate AR, the pixel electrodes 15 are arrayed substantially in a matrix on the transparent insulating substrate GL. In addition, a plurality of gate lines 29 (Y1 to Ym) are disposed along the rows of pixel electrodes 15, and a plurality of source lines 26 (X1 to Xn) are disposed along the columns of pixel electrodes 15. A plurality of pixel switches 27 are disposed near intersections between the gate lines 29 and source lines 26. Each of the pixel switches 27 is composed of a thin-film transistor that has a gate 28 connected to the gate line 29, and a source-drain path connected between the source line 26 and the pixel electrode 15. When the thin-film transistor is driven via the associated gate line 29, the thin-film transistor is rendered conductive between the associated source line 26 and the associated pixel electrode 15.

Each of the liquid crystal display elements 6 has a liquid crystal capacitance C1*c* between the pixel electrode 15 and the counter-electrode 16. Each of storage capacitance lines Cst (C1 to Cm) is capacitive-coupled to the pixel electrode 15 of each liquid crystal display element 6 on the associated row, thereby constituting a storage capacitance Cs.

The driving circuit DR is configured to control the transmittance of the LCD panel 41 by a liquid crystal application voltage that is applied to the liquid crystal layer LQ from the array substrate AR and counter-substrate CT. Each of the OCB liquid crystal display elements 6 serves as a pixel in a range of the associated pixel electrode 15. In the OCB liquid crystal display element, the alignment state of liquid crystal molecules needs to be transitioned from a splay alignment to a bend alignment capable of displaying an image, with the application of a transition voltage that is different from a normal driving voltage. For this purpose, each time the power switch PW is turned on, the driving circuit DR applies the transition voltage as a liquid crystal application voltage to the liquid crystal layer LQ, thereby performing initialization to transition the alignment state of liquid crystal molecules from the splay alignment to the bend alignment.

Specifically, the driving circuit DR comprises a gate driver 39 that sequentially drives the gate lines 29 to turn on the switching elements 27 on a row-by-row basis; a source driver 38 that outputs pixel voltages Vs to the source lines 26 while the switching elements 27 of each row are kept conductive by the driving of the associated gate line 29; a counter-electrode driver 40 that drives the counter-electrode 16 of the LCD panel 41; a backlight driving unit 9 that drives the backlight BL; a controller 37 that controls the gate driver 39, source driver 38, counter-electrode driver 40 and backlight driving unit 9; and a power supply circuit 7 that generates a plurality of internal power supply voltages, which are necessary for the gate driver 39, source driver 38, counter-electrode driver 40, backlight driving unit 9 and controller 37, from power (specifically, power supply voltage) that is supplied from the image information processing unit SG to the driving circuit DR.

The controller 37 outputs to the gate driver 39 a vertical timing control signal that is generated on the basis of the sync signal input from the image information processing unit SG. The controller 37 outputs to the source driver 38 a horizontal timing control signal and pixel data for one horizontal line, which are generated on the basis of the sync signal and display signal input from the image information processing unit SG. In addition, the controller 37 outputs an illumination control signal to the backlight driving unit 9. The gate driver 39 sequentially selects the gate lines 29 in one frame period under the control of the vertical timing control signal, and outputs to the selected gate line 29 a gate driving voltage that renders conductive the pixel switches 27 of the associated row for one horizontal scan period H. The source driver 38 converts, under the control of the horizontal timing control signal, pixel data for one horizontal line to pixel voltages Vs during the one horizontal scan period H in which the gate driving voltage is output to the selected gate line 29, and outputs the pixel voltages Vs to the source lines 26 in parallel.

The pixel voltage Vs is a voltage that is applied to the pixel electrode 15 with a common voltage VCOM used as a reference and output from the counter-electrode driver 40 to the counter-electrode 16. For example, the polarity of the pixel voltage Vs is reversed with respect to the common voltage VCOM in a frame-reversal drive scheme or a line-reversal drive scheme.

Figure 4:
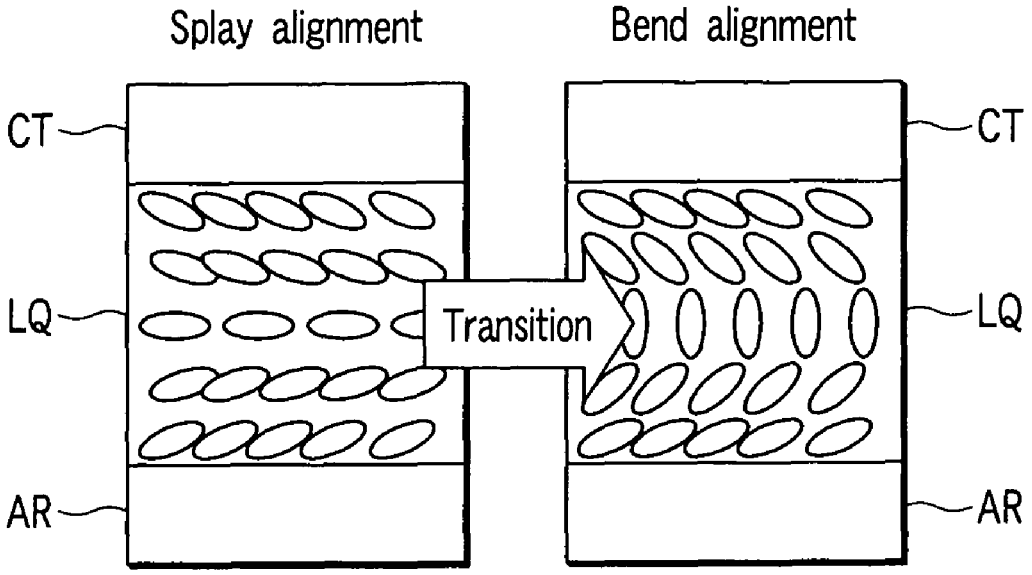
FIG. 4 is a diagram showing the alignment state of liquid crystal molecules, which is transitioned from a splay alignment to a bend alignment by a transition voltage that is applied as a liquid crystal application voltage in the OCB liquid crystal display element shown in FIG. 3.

In the liquid crystal display device 100, the controller 37 includes a transition voltage setting unit 1. The transition voltage setting unit 1 performs a transition voltage setting process for applying a transition voltage that causes the alignment state of liquid crystal molecules to be transitioned from the splay alignment to the bend alignment, as shown in FIG. 4, to each liquid crystal display element 6 as a liquid crystal application voltage. The transition voltage is so set that the potential of the counter-electrode 16 determined by the common voltage VCOM from the counter-electrode driver 40 may shift in a predetermined form in relation to the potential of the pixel electrode 15 determined by the pixel voltage Vs from the source driver 38. In addition, the liquid crystal display device 100 includes a clock signal generator 2 that supplies a clock signal to the transition voltage setting unit 1 upon supply of power to the power supply circuit 7 of the driving circuit DR. The clock signal is used as a reference for starting the application of the transition voltage in the transition voltage setting process performed by the transition voltage setting unit 1, and for measuring the time period of the application of the transition voltage. In this embodiment, the clock signal generator 2 operates with power (i.e. power supply voltage) from the image information processing unit SG. Alternatively, the clock signal generator 2 may be configured to operate with an internal power supply voltage that is generated by the power supply circuit 7.

Figure 5:
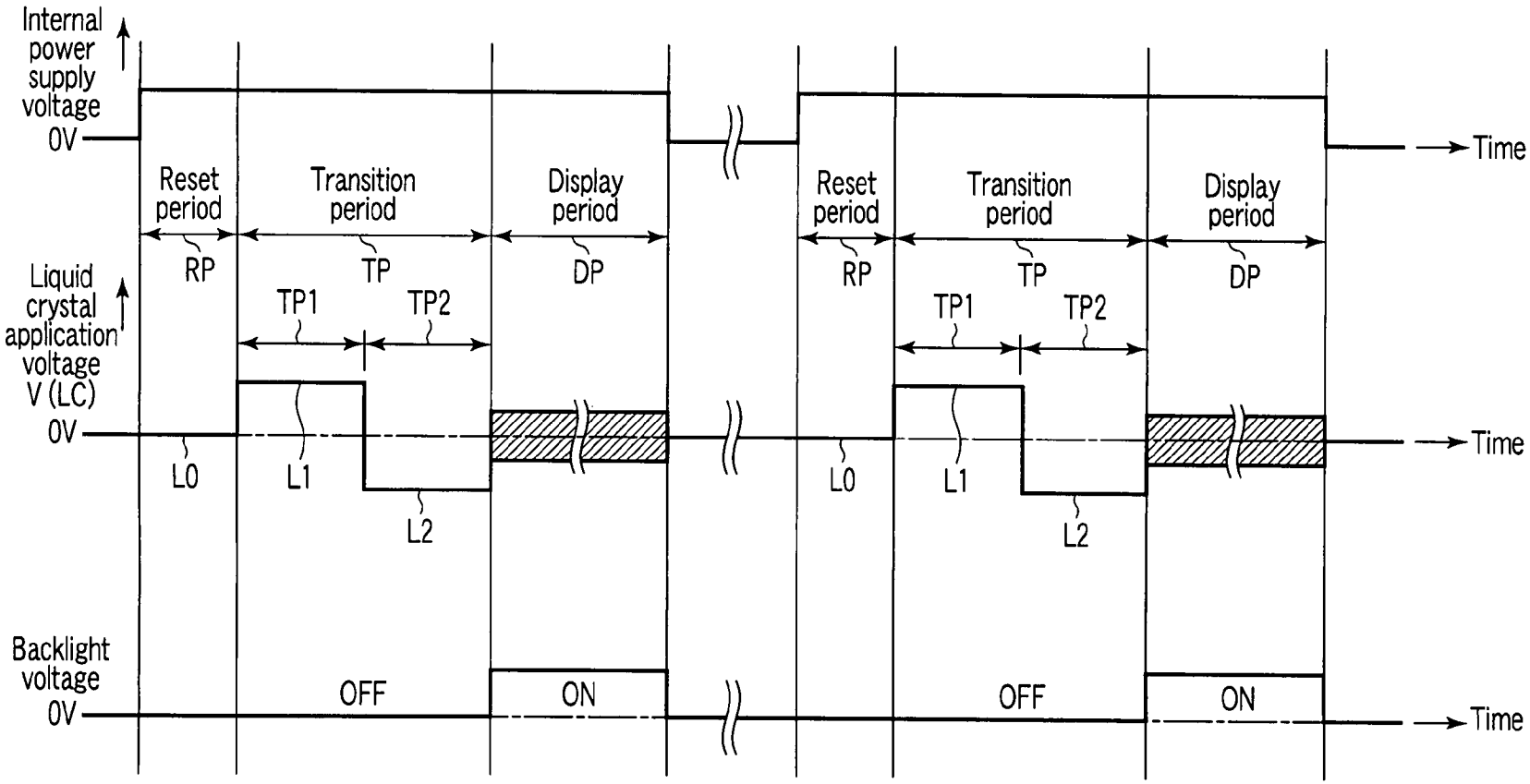
FIG. 5 is a waveform diagram for explaining an operation of the liquid crystal display device shown in FIG. 1.

The liquid crystal display device 100 operates, as shown in FIG. 5, with a power supply voltage that is supplied from the image information processing unit SG to the driving circuit DR.

The power supply circuit 7 converts the power supply voltage to internal power supply voltages, and supplies the internal power supply voltages to the controller 37, source driver 38, gate driver 39, counter-electrode driver 40 and backlight driving unit 9, for example. The clock signal generator 2 supplies a clock signal to the transition voltage setting unit 1 of the controller 37 in response to the power supply voltage supplied to the driving circuit DR. A response time of the clock signal generator 2, that is, a time period from the supply of the power supply voltage to the generation of the clock signal, is about 0.08 second or less. The transition voltage setting unit 1 performs the transition voltage setting process, and applies, from the timing of the supply of the clock signal, the transition voltage as a liquid crystal application voltage to each liquid crystal display element 6. In the transition voltage setting process, the transition voltage application period is divided into a reset period RP of about 0.4 second and a transition period TP of about 0.6 second, which follows the reset period RP. In the reset period RP, the transition voltage is maintained at a preset value for uniformizing the alignment state of liquid crystal molecules. In the transition period TP, the transition voltage is alternately changed to values with different polarities, which cause the alignment state of liquid crystal molecules to be substantially transitioned from the splay alignment to the bend alignment. The preset value L0 is substantially 0 V, and the absolute value of each of the values with different polarities is about 25 V. The transition period is further divided into a first-half transition period TP1 of about 0.3 second and a second-half transition period TP2 of about 0.3 second. The transition voltage is set at a value L1 of a first polarity, i.e. a positive polarity, in the first-half transition period TP1, and set at a value L2 of a second polarity, i.e. a negative polarity, in the second-half transition period TP2. In this case, the pixel voltage Vs is fixed, and the common voltage VCOM output from the counter-electrode driver 40 is varied so as to obtain the above-described transition voltage. The transition voltage setting unit 1 confirms the elapse of the reset period RP and transition period TP by counting the clock signal, and completes the transition voltage setting process. At the time of completion, about 1.08 seconds have elapsed from the supply of the power supply voltage to the driving circuit DR.

In a subsequent video display period DP, the controller 37 fixes the common voltage VCOM to be output from the counter-electrode driver 40, and controls the source driver 38, gate driver 39 and counter-electrode driver 40 to apply a liquid crystal application voltage obtained by varying the pixel voltage Vs in accordance with the pixel data, to each liquid crystal display element 6. The controller 37 controls the backlight driving unit 9 to keep the backlight BL in an off-state in the transition voltage application period (reset period RP+transition period TP), and to set the backlight BL in an on-state in the display period DP. Thereby, the matrix array of liquid crystal display elements 6 is enabled to display an image. The above-described operation ends when supply of the power supply voltage to the driving circuit DR is stopped, and the operation is repeated in a similar manner when the power supply voltage is supplied again.

Figure 6:
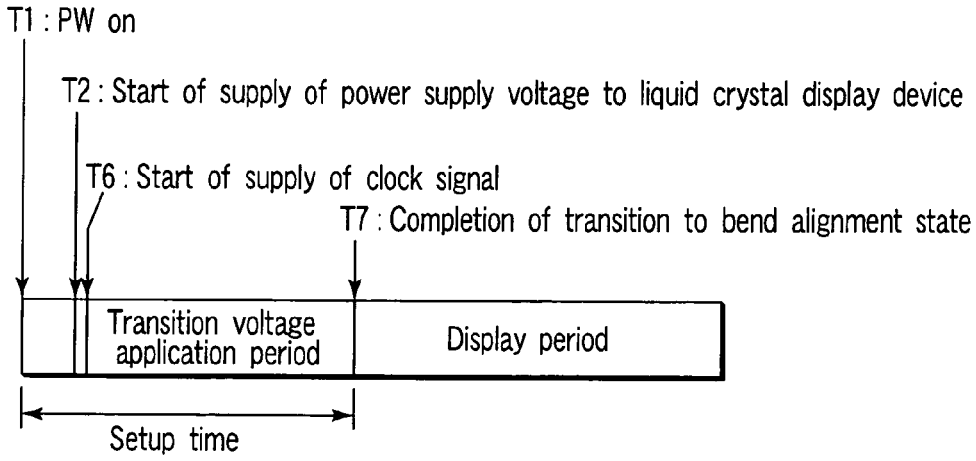
FIG. 6 is a view for explaining a setup time in the liquid crystal display device shown in FIG. 1.
Figure 7:
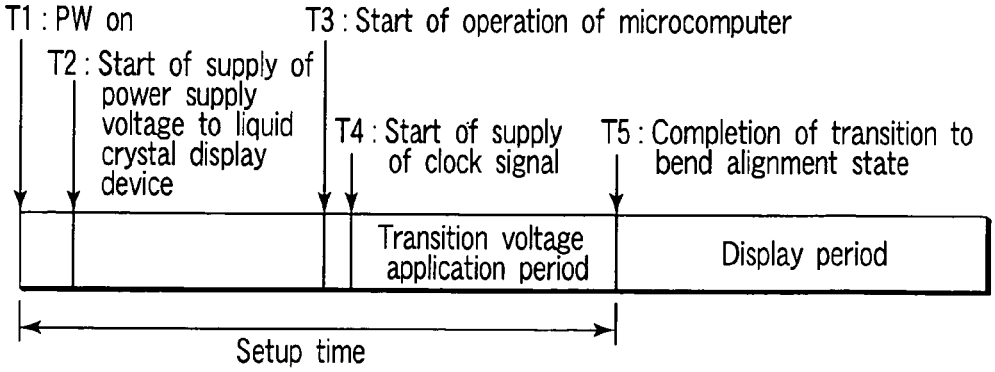
FIG. 7 is a view for explaining a setup time in a conventional liquid crystal display device.

FIG. 6 illustrates the setup time of the liquid crystal display device 100. After supply of power responsive to an operation of the power switch PW on the side of the image information processing unit SG, the user of the TV set or mobile phone has to wait for a setup time until an image is displayed. Compared to FIG. 7, like the prior art, the image information processing unit SG waits until its own power supply unit is stabilized, after the power switch PW is turned on at T1. At T2, the image information processing unit SG outputs a power supply voltage to the driving circuit DR of the liquid crystal display device 100. Upon supply of the power supply voltage, the clock generator 2 supplies a clock signal to the transition voltage setting unit 1 at T6, which is earlier than T4 in FIG. 7. Thus, the transition to the bend alignment is completed at T7, which is earlier than T5 in FIG. 7.

According to the present embodiment, supply of the clock signal from the clock signal generator 2 is started immediately after power supply to the driving circuit DR. Thus, the application of the transition voltage is started earlier than in the prior art. Accordingly, the setup time that is needed until image display can be decreased. Hence, the user can use the TV set or mobile phone more quickly than in the prior art, after the operation of the power switch PW. Furthermore, since the backlight BL is kept in the off-state during the transition voltage application period, it is possible to prevent unnecessary light from leaking from the LCD panel 41.

The present invention is not limited to the above-described embodiment, and the invention can variously be modified without departing from the spirit of the invention.

In the embodiment, the transition period TP is divided into the first-half transition period TP1 and second-half transition period TP2, and the transition voltage is set at values of different polarities between the first-half transition period TP1 and second-half transition period TP2. Alternatively, the transition voltage may be set at a DC value of one of the positive and negative polarities, thereby causing the alignment state of liquid crystal molecules to be transitioned from the splay alignment to the bend alignment.

The first-half transition period TP1 and second-half transition period TP2 are set to be equal. However, the lengths of the transition periods TP1 and TP2 may arbitrarily be set. For example, if the length of the second-half transition period TP2 is limited to about 70% of the first-half transition period TP1, flicker can advantageously be reduced.

The transition voltage application period is divided into the reset period RP and transition period TP, and the transition voltage is maintained at a preset value for uniformizing the alignment state of liquid crystal molecules. Alternatively, the reset period RP may not be provided, and the transition voltage application period may comprise only the transition period TP in which the alignment state of liquid crystal molecules is substantially transitioned from the splay alignment to the bend alignment.

The clock signal generator 2 is disposed in the liquid crystal module that includes the LCD panel 41 serving as the liquid crystal display element section, and the driving circuit DR. Alternatively, the clock signal generator 2 may be disposed in the image information processing unit SG, if the clock signal generator 2 is configured to independently supply the clock signal to the transition voltage setting unit 1 of the driving circuit DR upon supply of the power supply voltage to the driving circuit DR. Furthermore, the clock signal generator 2 may be provided with a detector, which detects supply of power supply voltage to the driving circuit DR in order to start the generation of the clock signal.

The present invention is applicable to a liquid crystal display device that uses OCB liquid crystal display elements in order to display an image.

What is claimed is:

1. A liquid crystal display device comprising:

a liquid crystal display element section that is initialized such that the alignment state of liquid crystal molecules is transitioned from a splay alignment to a bend alignment capable of displaying an image;

a driving circuit that applies to said liquid crystal display element section a transition voltage that causes the alignment state of liquid crystal molecules to be transitioned from the splay alignment to the bend alignment as the initialization, and that drives the liquid crystal display element section in accordance with a display signal and a sync signal supplied together as a processing result of an external image information processing unit after the initialization; and a clock signal generator that generates upon supply of power to said driving circuit executed prior to the supply of the sync signal, a clock signal, which is delivered to said driving circuit, as a reference for starting application of the transition voltage and for measuring a transition voltage application period in which the transition voltage is applied, wherein the transition voltage application period is divided into a reset period and a transition period following the reset period, and the driving circuit is configured to output a first voltage signal during the reset period to maintain the transition voltage at a preset value for uniformizing the alignment state of liquid crystal molecules in the reset period, and to output a second voltage signal during the transition period, the second voltage signal being different from the first voltage signal, to set the transition voltage at a value which causes the alignment state of the liquid crystal molecules to be transitioned from the splay alignment to the bend alignment in the transition period.

2. The liquid crystal display device according to claim 1, wherein said clock signal generator is configured to respond to a power supply voltage which is stabilized before a substantive image information process begins upon activation of said image information process unit, and is supplied from said image information process unit to said driving circuit.

3. The liquid crystal display device according to claim 2, wherein said clock signal generator is disposed in one of said image information processing unit and a module that includes said driving circuit and said liquid crystal display element section.

4. The liquid crystal display device according to claim 2, wherein a response time of said clock signal generator is 0.08 second or less.

5. The liquid crystal display device according to claim 2, wherein said liquid crystal display element section comprises a first electrode substrate in which a plurality of pixel electrodes are covered with an alignment film and arrayed in a matrix, a second electrode substrate in which a counter-electrode is covered with an alignment film and disposed to face said pixel electrodes, and a liquid crystal layer that is held between said first and second electrode substrates in contact with each of said alignment films, so as to form liquid crystal display elements each serving as a pixel in a range of the associated pixel electrode, and said driving circuit is configured to apply the transition voltage such that a potential of said counter-electrode shifts relative to a potential of each of said pixel electrodes.

6. The liquid crystal display device according to claim 1, wherein the reset period is set with reference to 0.4 second, and the transition period is set with reference to 0.6 second.

7. The liquid crystal display device according to claim 1, wherein the preset value is set with reference to 0 V.

8. The liquid crystal display device according to claim 1, further comprising a backlight that illuminates said liquid crystal display element section, and a backlight driving unit that keeps said backlight in an off-state during the transition voltage application period.

* * * * *